US006629606B1

(12) United States Patent
Barthel et al.

(10) Patent No.: US 6,629,606 B1
(45) Date of Patent: Oct. 7, 2003

(54) PACKAGING FOR TABLET-SHAPED OBJECTS

(75) Inventors: Wolfgang Barthel, Duesseldorf (DE); Werner Kuenzel, Langenfeld (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/600,835

(22) PCT Filed: Jan. 15, 1999

(86) PCT No.: PCT/EP99/00199

§ 371 (c)(1),
(2), (4) Date: Sep. 8, 2000

(87) PCT Pub. No.: WO99/37557

PCT Pub. Date: Jul. 29, 1999

(30) Foreign Application Priority Data

Jan. 24, 1998 (DE) ..... 198 02 664

(51) Int. Cl.[7] ..... B65D 85/00
(52) U.S. Cl. ..... 206/526; 206/499; 53/202
(58) Field of Search ..... 206/484, 499, 206/521, 526; 53/449, 202

(56) References Cited

U.S. PATENT DOCUMENTS 1,905,027 A 4/1933 Amatel
2,194,451 A * 3/1940 Soubier
2,284,171 A 5/1942 Silberman
2,577,765 A * 12/1951 Irmscher
3,199,671 A * 8/1965 Davy
3,367,489 A 2/1968 Schneider et al.
3,628,656 A * 12/1971 Knuchel
4,180,164 A * 12/1979 Durden et al.

FOREIGN PATENT DOCUMENTS

WO WO92 20593 A 11/1992

* cited by examiner

*Primary Examiner*—David T. Fidei
(74) *Attorney, Agent, or Firm*—Stephen D. Harper; Glenn E. J. Murphy

(57) ABSTRACT

A pack for tablet-like objects, such as hygroscopic laundry/dishwasher detergent tablets, for example, includes a dual packing configuration of a closed outer pack containing a plurality of individual film bags, with each of the individual film bags being closed at opposing ends by a transverse seam, and along their lengths by a longitudinal seam. Each of the individual film bags enclose at least one tablet. The individual film bags are inserted into the outer pack with the longitudinal seams of the film bags aligned parallel to one another, and with the sidewalls of the outer pack parallel to the longitudinal seams of the film bags. The longitudinal seams of the film bags are reinforced.

16 Claims, 1 Drawing Sheet

PACKAGING FOR TABLET-SHAPED OBJECTS

BACKGROUND

1. Field of the Invention

This invention relates gradually to a pack for tablet-like objects, and more particularly hygroscopic laundry/dishwasher detergent tablets, comprising a closed outer pack and film bags which are arranged in the outer pack and in each of which at least one tablet is accommodated, each film bag being closed at either end by a transverse seam and, along its length, by a longitudinal seam, and to a process for the production of such a pack in which film bags closed at either end by a transverse seam and, along their length, by a longitudinal seam—and each accommodating at least one tablet-like object, more particularly a hygroscopic laundry/dishwasher detergent tablet, are introduced into an outer pack and the outer pack is then close.

2. Discussion of Related Art

Laundry/dishwasher detergent tablets, which have to be protected against moisture, for example because of their hygroscopic properties, are generally packed in film bags. So-called flow packs, for example, have been successfully used in practice. Flow packs consist of a tubular film bag with one longitudinal seam and two transverse seams, so-called fins. The production of flow packs is known and is normally carried out in high-performance machines immediately after production of the tablets.

Tablets wrapped (one or more at a time) in such film bags are normally packed loosely in a box-like container, such as a packet, a carry bag, drum or the like, which in principle forms a sufficiently stable outer pack for storage and transportation. Stability in this regard relates to the necessary compressive strength of the container under pressure and the loads applied during storage in pallets.

Unfortunately, detergent tablets are breakable products which, during packaging and transportation, are generally stressed to such an extent that edge breakage, fracture and abrasion are unavoidable, even with normal stable outer packs. The tablet is not protected against such damage by the film bag either which only affords slight additional protection against impact stress and in transit.

SUMMARY OF THE INVENTION

An object of the present invention is to improve a pack of the type previously mentioned, that is easily manufactured, and provides packaging that avoids direct impact or compressive stressing of the tablet.

According to one embodiment of the invention, this object is satisfied by a pack of the type previously mentioned wherein the film bags are arranged sorted in the outter pack with their longitudinal seams aligned parallel to one another with the sidewalls of the outer pack parallel to the longitudinal seams of the film bags which are reinforced.

It has been found that the film bags according to the invention are able to accommodate impacts parallel to the longitudinal seam relatively well; these impacts would appear to be absorbed by the transverse fins (transverse seams) of the film bag. Utilizing this discovery, the sorted arrangement of the film bags in the outer pack ensures that the impact stresses parallel to the longitudinal seams cannot result in damage to the tablets. By virtue of the special design of the outer pack with reinforced walls, impact stresses in the transverse direction, i.e. parallel to the transverse seams, are arrested in the correspondingly reinforced side walls of the outer pack so that, overall, the invention provides a pack which affords the tablets accommodated therein reliable mechanical protection in storage and in transit. The increased effort involved in production in relation to known packs is negligible, the tablet-filled film bags merely having to be placed in sorted form in the outer pack. At the same time, tablet damage during filling of the outer pack, which could occur in the event of uncontrolled packing, is thus avoided.

The properties of the pack and the protection afforded to the tablets accommodated therein can be further improved by equipping at least the reinforced sidewalls of the outer pack with shock-absorbing inserts. The inserts can be made, for example, of corrugated cardboard.

To protect the pack against downward pressures, for example during palleting, and against spread loads, the outer pack is advantageously self-supporting, i.e. its dimensions are such that the stacking of several packs one above the other does not result in any damage to the packs in the lower layers.

To solve the problem stated above, the invention also provides a process for the production of the inventive pack in which film bags closed at either end by a transverse seam and, along their length, by a longitudinal seam with each accommodating at least one tablet-like object, more particularly a hygroscopic laundry/dishwasher detergent tablet, are introduced into an outer pack outer pack is then closed. The process according to the invention provides for the film bags being introduced in sorted form with their longitudinal seams parallel to one another into the outer pack and with reinforcements in the sidewalls arranged parallel to the longitudinal seams.

This process involves only slightly more complexity than conventional processes where the tablets packed in film bags are loosely introduced into the outer pack whereby the present process requires the addition of a device which stacks and sorts the film bags in the outer pack.

BRIEF DESCRIPTION OF THE DRAWING

The invention is described in more detail in the following with reference to the accompanying drawings, in which like items are identified by the same reference designation, wherein.

DETAILED DESCRIPTION OF THE INVENTION

Figure 1:
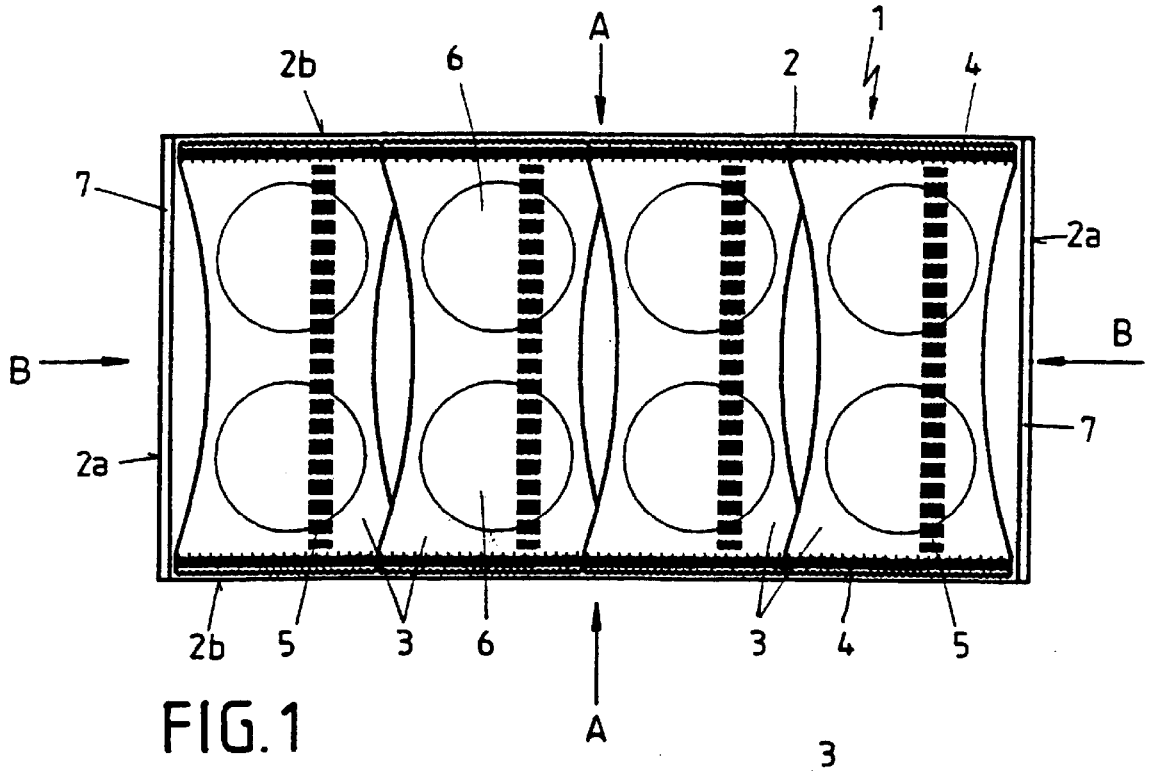
FIG. 1 shows a pack according to the invention without a cover.
Figure 2:
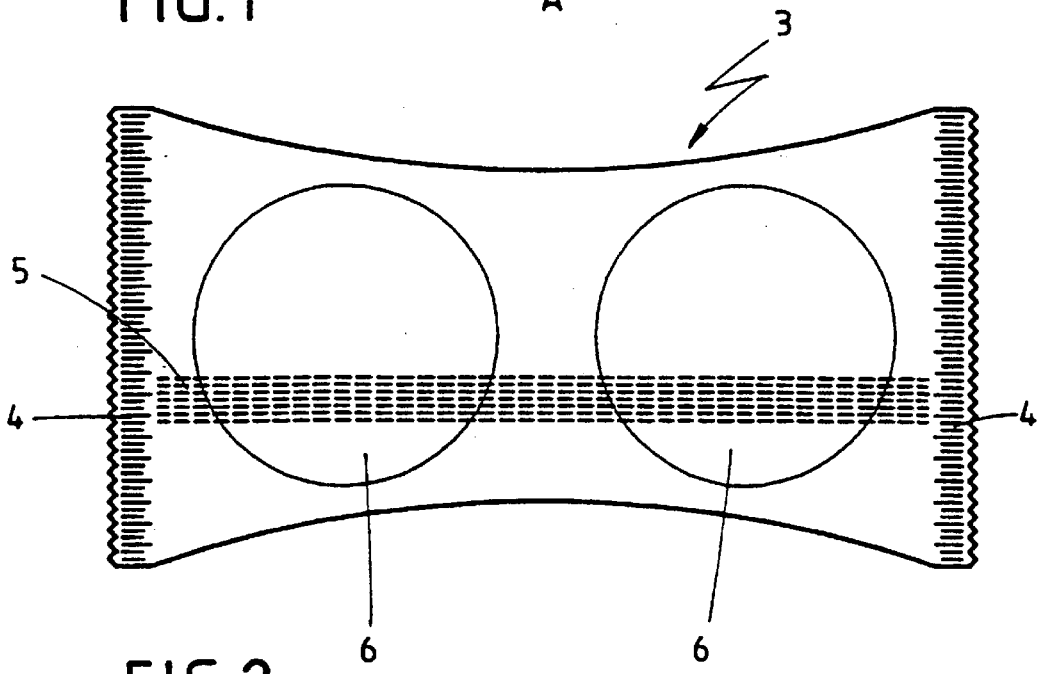
FIG. 2 is a view on a larger scale of a film bag with two tablets accommodated therein.

A pack according to the invention for packaging tablet-like objects, more particularly hygroscopic laundry/dishwasher detergent tablets, is generally denoted by the reference numeral 1 in the drawing. It comprises a closed outer pack 2 and a plurality of film bags 3, as shown in FIG. 1. An individual film bag is shown in detail in FIG. 2.

One such film bag 3 is formed from a tubular film and is closed at either end by transverse seams or transverse fins 4. Over its length, the film bag 3 is closed by a longitudinal seam 5. Before it is closed, the film bag 3 is filled with (a) detergent tablet(s) 6. In the illustrated embodiment, one film bag 3 accommodates two detergent tablets 6.

According to one embodiment of the invention, the film bags 3 are arranged sorted in the outer pack 2 with their longitudinal seams 5 aligned parallel to one another as can be seen from FIG. 1. The outer pack 2 itself comprises two first sidewalls 2*a* at opposing ends, which are arranged parallel to the longitudinal seams 5 of the film bags 3, and two second sidewalls 2*b* arranged at a right-angle thereto. The two sidewalls 2*a*, which are arranged parallel to the longitudinal seams 5 of the film bags 3, are reinforced. In addition, the sidewalls 2*a* can be provided on their interior surfaces with shock-absorbing inserts 7, for example of corrugated cardboard, which are correspondingly inserted into the outer pack 2.

If a pressure is applied to the outer pack 1 in the direction of the arrows A, i.e. parallel to the longitudinal seam 5 of a film bag 3, it is absorbed by the transverse seams 4 of the film bags 3 without damaging the tablets 6. If on the other hand the pack 1 is stressed in the transverse direction, i.e. in the direction of the arrows B, the stress is absorbed by the reinforcements of the sidewalls 2*a* and in addition by the inserts 7, so that compressive stresses on the lateral weak spots of the film bags 3 and hence the tablets 6 are avoided.

In addition, the outer pack 2 can also be made self-supporting so that several outer packs can be safely stacked one above the other.

In addition, the reinforcement of the sidewalls 2*a* of the outer pack 1, which can be provided very easily by making the pack double-walled in this region, increases the compressive strength of the pack 1 as a whole in transit and during storage in a pallet. Overall, the invention provides a pack 1 for tablets 6 which affords the breakable tablets 6 in the pack 1 broad protection.

The invention is not of course confined to the illustrated embodiment. Other embodiments are possible without departing from the basic concept. Thus, several layers of film bags 3 filled with tablets 6 can also be arranged one above the other in the outer pack 2, the stacking pattern of all the layers being the same to guarantee the necessary sorted arrangement of the film bags 3 in the outer pack 2. In addition, the pack 1 can be closed on top. In the interests of clarity, however, cover laps or the like have not been shown in the drawing.

What is claimed is:

1. A pack of hygroscopic laundry/dishwasher detergent tablets, comprising:

a closed outer pack; and a plurality of films bags which are arranged in the outer pack, and in each said plurality of film bags at least one tablet is accommodated, each of said plurality of film bags being closed at either end by a transverse seam and, along its length, by a longitudinal seam, respectively, each of said plurality of film bags are arranged sorted in the outer pack with their longitudinal seems aligned parallel to one another, with the sidewalls of the outer pack parallel to the longitudinal seams of each one of said plurality of film bags, said side walls being reinforced.

2. A pack as claimed in claim 1, wherein at least the reinforced side walls (2*a*) of the outer pack (2) are equipped with shock-absorbing inserts (7).

3. A pack as claimed in claim 2, wherein the shock-absorbing inserts (7) are made of corrugated cardboard.

4. A pack as claimed in claim 1 or any of the following claims, wherein the outer pack (2) is self-supporting.

5. A process for the production of the pack claimed in claim 1, in which film bags closed at either end by a transverse seam and, along their length, by a longitudinal seam and each accommodating at least one tablet-like object, more particularly a hygroscopic laundry/dishwasher detergent tablet, are introduced into an outer pack and the outer pack is then closed, wherein the film bags (3) are introduced in sorted form with their longitudinal seams (5) parallel to one another into the outer pack (2) with reinforcements in its side walls (2*a*) arranged parallel to the longitudinal seams (5).

6. A pack as claimed in claim 1, wherein at least the reinforced sidewalls of the outer pack are equipped with shock absorbing inserts.

7. A pack as claimed in claim 6, wherein the shock absorbing inserts are made of corrugated cardboard.

8. A pack as claimed in claim 1, wherein the outer pack is self-supporting.

9. A pack as claimed in claim 2, wherein the outer pack is self supporting.

10. A pack as claimed in claim 3, wherein the outer pack is self supporting.

11. A pack as claimed in claim 4, wherein the outer pack is self supporting.

12. A pack as claimed in claim 5, wherein the outer pack is self supporting.

13. A pack as claimed in claim 6, wherein the outer pack is self supporting.

14. A pack as claimed in claim 7, wherein the outer pack is self supporting.

15. A pack as claimed in claim 8, wherein the outer pack is self supporting.

16. A process for the production of the pack claimed in claim 1, in which each of said plurality of film bags are closed at either end by a transverse seam, and each accommodating at least one hygroscopic laundry/dishwasher detergent tablet, are introduced into a said outer pack and the outer pack is then closed, wherein each of said plurality of film bags are introduced in sorted form with their longitudinal seams parallel to one another into the outer pack whereby reinforcements in the sidewalls of the outer pack are arranged parallel to the longitudinal seams of each said plurality of film bags.

* * * * *

UNITED STATES PATENT AND TRADEMARK OFFICE

CERTIFICATE OF CORRECTION

PATENT NO. : 6,629,606 B1
DATED : October 7, 2003
INVENTOR(S) : Barthel et al.

It is certified that error appears in the above-identified patent and that said Letters Patent is hereby corrected as shown below:

Column 3,
Line 46, delete “films” and insert therefore -- film --.
Line 53, delete “seems” and insert therefore -- seams --.

Signed and Sealed this

Twenty-third Day of August, 2005

JON W. DUDAS
*Director of the United States Patent and Trademark Office*